US007124726B2

(12) United States Patent
Roe

(10) Patent No.: US 7,124,726 B2
(45) Date of Patent: Oct. 24, 2006

(54) LOW-PROFILE INTAKE MANIFOLD

(75) Inventor: Sean L. Roe, Jacksonville, FL (US)

(73) Assignee: Salor Motorsports, Inc., Jacksonville, FL (US)

( * ) Notice: Subject to any disclaimer, the term of this patent is extended or adjusted under 35 U.S.C. 154(b) by 97 days.

(21) Appl. No.: 10/605,224

(22) Filed: Sep. 16, 2003

(65) Prior Publication Data

US 2004/0255891 A1 Dec. 23, 2004

Related U.S. Application Data

(60) Provisional application No. 60/320,122, filed on Apr. 18, 2003, provisional application No. 60/410,979, filed on Sep. 16, 2002.

(51) Int. Cl.
*F02M 35/10* (2006.01)

(52) U.S. Cl. ..... 123/184.42

(58) Field of Classification Search ..... 123/184.24, 123/184.34, 184.42, 184.47
See application file for complete search history.

(56) References Cited

U.S. PATENT DOCUMENTS

| | | | | |
|---|---|---|---|---|
| 4,364,340 | A * | 12/1982 | Kimura | 123/184.34 |
| D267,952 | S | 2/1983 | Martin | |
| 5,163,406 | A | 11/1992 | Daly | |
| 5,168,839 | A * | 12/1992 | Hitomi et al. | 123/184.42 |
| 5,494,011 | A | 2/1996 | Haller | |
| 5,651,338 | A * | 7/1997 | Pacheco et al. | 123/184.34 |
| 6,067,949 | A * | 5/2000 | Hughes et al. | 123/184.34 |
| 6,192,849 | B1 * | 2/2001 | Powell | 123/184.34 |
| 6,216,656 | B1 * | 4/2001 | Hada et al. | 123/184.34 |
| 6,234,132 | B1 * | 5/2001 | Kopec et al. | 123/184.34 |
| 6,308,686 | B1 | 10/2001 | Mammarella et al. | |
| D465,790 | S | 11/2002 | Magnuson | |

* cited by examiner

*Primary Examiner*—Marguerite McMahon
(74) *Attorney, Agent, or Firm*—Moore & Van Allen PLLC; John E. Slaughter, III

(57) ABSTRACT

An intake manifold according to the present invention comprises a housing defining an interior cavity and having an exterior surface. The housing has at least one air in-flow passage from the exterior surface of the housing to the interior cavity. The housing includes at least one side wall, the side wall having a substantially planar side wall interior cavity surface and a side wall exterior surface. The side wall defines at least one air-fuel out-flow passage from the interior cavity to the side wall exterior surface, wherein the intake manifold is mounted to engage an engine block so that the air-fuel out-flow passage and an engine cylinder inlet are aligned to allow the air-fuel mixture to pass from the air-fuel out-flow passage to the engine cylinder inlet.

2 Claims, 6 Drawing Sheets

56
58
60
66
68
70

LOW-PROFILE INTAKE MANIFOLD

CROSS REFERENCE TO RELATED APPLICATIONS

This application claims the benefit of U.S. Provisional Application No. 60/410,979, filed Sep. 16, 2002, and U.S. Provisional Application No. 60/320,122, filed Apr. 18, 2003, the contents of both of which are incorporated herein by reference.

BACKGROUND OF INVENTION

This invention relates generally to an intake manifold for a vehicle engine, and more particularly to an intake manifold with a low-profile design.

An intake manifold in a vehicle engine is used for receiving air for delivery to the engine. A conventional intake manifold is a one piece design mounted to the top of the engine. The intake manifold generally includes a housing, one or more air inlets, or access ports, opening into an internal plenum area, and one or more conduits, or runners, leading from the plenum area to each engine cylinder. The conventional intake manifold is part of an engine intake system, which includes one or more intake tubes and fuel injectors. The intake tubes receive air from the environment and deliver the air to the intake manifold. Air is received into the plenum area via the air inlets. The air then disperses to the runners for delivery to each engine cylinder. Fuel is typically delivered to the runners via fuel injection passages which receive the fuel from fuel injectors. The fuel and air then mix together, and the air-fuel mixture in the intake manifold runners is delivered via cylinder inlets to each cylinder of the engine.

An important feature of the intake manifold is the runner length. The intake manifold runners must be of a sufficient length to provide a fuel-flow velocity which efficiently delivers the air-fuel mixture to the engine cylinders. Conventional intake manifold runners typically extend into the plenum area of the intake manifold or extend externally of the intake manifold housing in order to provide the necessary runner length. This results in the intake manifold being too large to accommodate an air compressor mounted on top of the intake manifold within the engine compartment.

Optionally, an air compressor can be mounted within the engine compartment to receive the air from the intake tubes, compress the air, and deliver the compressed air to the intake manifold. The air compressor functions to provide additional air to the engine and enables more power to be generated by the engine. A bypass valve can also be mounted on the intake manifold to allow air from the intake manifold to be recirculated to intake tubes based on the vacuum state in the plenum area.

The original equipment manufacturer (OEM) hood for vehicles is designed to close over an OEM intake manifold and other engine components. The OEM hood is minimized in height over the components in the engine compartment in order to improve the vehicle's aerodynamics, as well as to minimize any detrimental effect on the vision of the vehicle operator. If one desires to install an air compressor to provide increased air flow to the intake manifold, the air compressor is usually installed in locations other than on top of the OEM intake manifold due to the lack of space. If the air compressor is mounted on top of the intake manifold, there is usually not enough space available under the OEM hood. Rather, the original hood must be replaced with an enlarged-space hood, which increases the cost associated with installing an air compressor, as well as reducing the vehicles aerodynamics and vehicle operator vision. Alternatively, an area is cut out of the original hood, which can lead to issues with structural instability, as well as increasing the cost due to the cutting involved and makes the hood of less value for resale.

For the foregoing reasons, there is a need for an intake manifold having a low-profile design. The new intake manifold should allow a user to mount an air compressor on top of the intake manifold without having to replace or modify the OEM hood.

SUMMARY OF INVENTION

An intake manifold according to the present invention comprises a housing defining an interior cavity and having an exterior surface. The housing has at least one air in-flow passage from the exterior surface of the housing to the interior cavity. The housing includes at least one side wall, the side wall having a substantially planar side wall interior cavity surface and a side wall exterior surface. The side wall defines at least one air-fuel out-flow passage from the interior cavity to the side wall exterior surface, wherein the intake manifold is mounted to engage an engine block so that the air-fuel out-flow passage and an engine cylinder inlet are aligned to allow the air-fuel mixture to pass from the air-fuel out-flow passage to the engine cylinder inlet.

Also, an intake manifold according to the present invention comprises a housing having an exterior surface and defining an interior cavity. The housing has at least one air in-flow passage from the exterior surface of the housing to the interior cavity. The housing includes at least one side wall, the side wall having a substantially planar side wall interior cavity surface and a substantially planar side wall exterior surface. The side wall defines at least one air-fuel out-flow passage from the interior cavity to the side wall exterior surface.

Further, an intake manifold according to the present invention comprises a housing having an exterior surface and defining an interior cavity. The housing has at least one air in-flow passage from the exterior surface of the housing to the interior cavity. The housing includes at least one side wall, the side wall defining at least one air-fuel out-flow passage from the interior cavity to the side wall exterior surface. The housing defines at least one fuel in-flow passage from the exterior surface of the housing and opening into the air-fuel out-flow passage.

Additionally, an intake manifold according to the present invention comprises a housing having an exterior surface and defining an interior cavity. The housing has at least one air in-flow passage from the exterior surface of the housing to the interior cavity and at least one air-fuel out-flow passage from the interior cavity to the exterior surface of the housing. The housing includes an upper section and a lower section, the upper section mounted on the lower section, the upper section having an upper section interior cavity surface and an upper section exterior surface, and the upper section having one or more air compressor mounting passages from the upper section interior cavity surface to the upper section exterior surface. The air compressor mounting passages extend through the upper section to enable one or more air compressor mounting fasteners to mount the air compressor to the upper section exterior surface. The air compressor is mounted on the upper section. The lower section mounted on the engine such that the engine is not substantially of a greater height with the intake manifold and the air compressor mounted than the set height of the engine with a pre-existing intake manifold replaced by the intake manifold and air compressor.

Yet further, an intake manifold according to the present invention comprises a housing having an exterior surface and defining an interior cavity. The housing has at least one air in-flow passage from the exterior surface of the housing to the interior cavity and at least one air-fuel out-flow passage from the interior cavity to the exterior surface of the housing. The housing includes an upper section and a lower section, the upper section mounted on the lower section. The lower section is mounted on an engine by one or more lower section fasteners by advancing the fasteners through the lower section to the engine in one direction and the upper section is mounted on the lower section such that the lower section fasteners are prevented from moving in any other direction.

An engine according to the present invention comprises an engine block having at least one cylinder with an inlet for supplying an air-fuel mixture to the cylinder and an intake manifold. The intake manifold comprises a housing defining an interior cavity and having an exterior surface, and at least one air in-flow passage from the exterior surface of the housing to the interior cavity. The housing includes at least one side wall, the side wall having a substantially planar side wall interior cavity surface and a side wall exterior surface. The side wall defines at least one air-fuel out-flow passage from the interior cavity to the side wall exterior surface, wherein the intake manifold is mounted to engage the engine block so that the air-fuel out-flow passage and the engine cylinder inlet are aligned to allow the air-fuel mixture to pass from the air-fuel out-flow passage to the engine cylinder inlet.

Also, an engine according to the present invention comprises an engine block with at least one cylinder inlet and an intake manifold. The intake manifold comprises a housing defining an interior cavity and having an exterior surface, at least one air in-flow passage from the exterior surface of the housing to the interior cavity, and at least one air-fuel out-flow passage from the interior cavity to the exterior surface of the housing. The housing includes an upper section and a lower section, the upper section mounted on the lower section. The lower section is mounted on the engine by one or more lower section fasteners by advancing the fasteners through the lower section to the engine in one direction, and the upper section is mounted on the lower section such that the lower section fasteners are prevented from moving in any other direction.

BRIEF DESCRIPTION OF DRAWINGS

For a more complete understanding of the present invention, reference should now be had to the embodiment shown in the accompanying drawings and described below.

DETAILED DESCRIPTION

Certain terminology is used herein for convenience only and is not to be taken as a limitation on the invention. For example, words such as upper, lower, right, horizontal, vertical, upward, and downward, merely describe the configuration in the Figures. Indeed, the components may be oriented in any direction and the terminology, therefore, should be understood as encompassing such variations unless specified otherwise.

Figure 1:
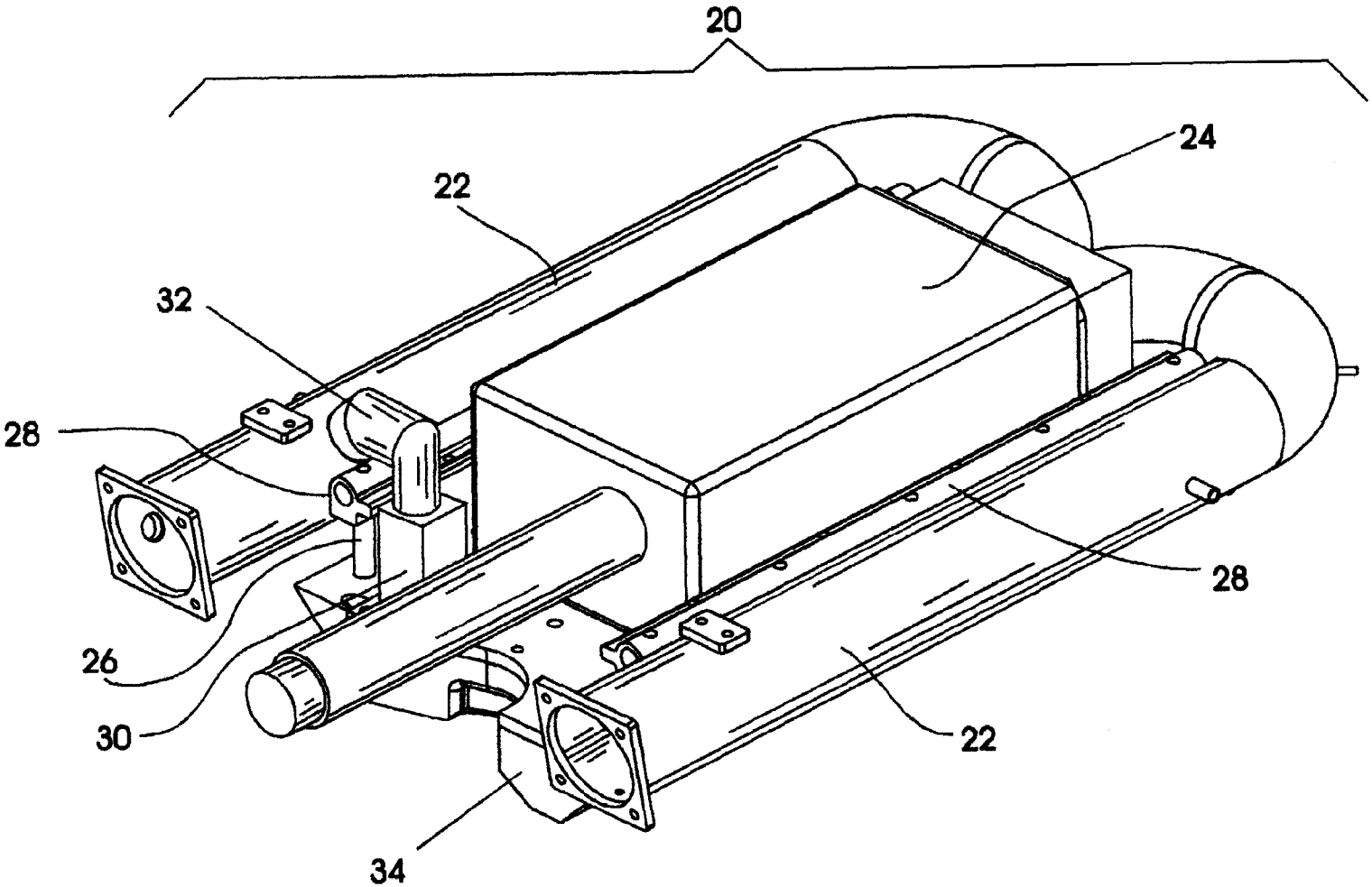
FIG. 1 is a perspective view of the intake system.

Referring now to the drawings, wherein like reference numerals designate corresponding or similar elements throughout the several views, an embodiment of a vehicle engine intake system according to the present invention is shown in FIG. 1 and generally designated at 20. The intake system 20 is mounted on an engine (not shown) and includes two intake tubes 22, an air compressor 24, a plurality of fuel injectors 26 mounted on fuel injector rails 28, a bypass valve 30, a bypass valve connector 32, and an intake manifold 34. The air compressor 24, fuel injectors 26, and bypass valve 30 are attached to the top surface of the intake manifold 34. Each intake tube 22 has an inlet end attached to a throttle body (not shown) through which air enters the intake tube 22, and an outlet end which is attached, usually by way of a hose clamp, to an inlet on the air compressor 24 to enable air to flow through the intake tubes 22 into the air compressor 24. The bypass valve 30 is connected by a bypass valve connector 32, typically a hose, to one of the intake tubes 22.

Figure 2:
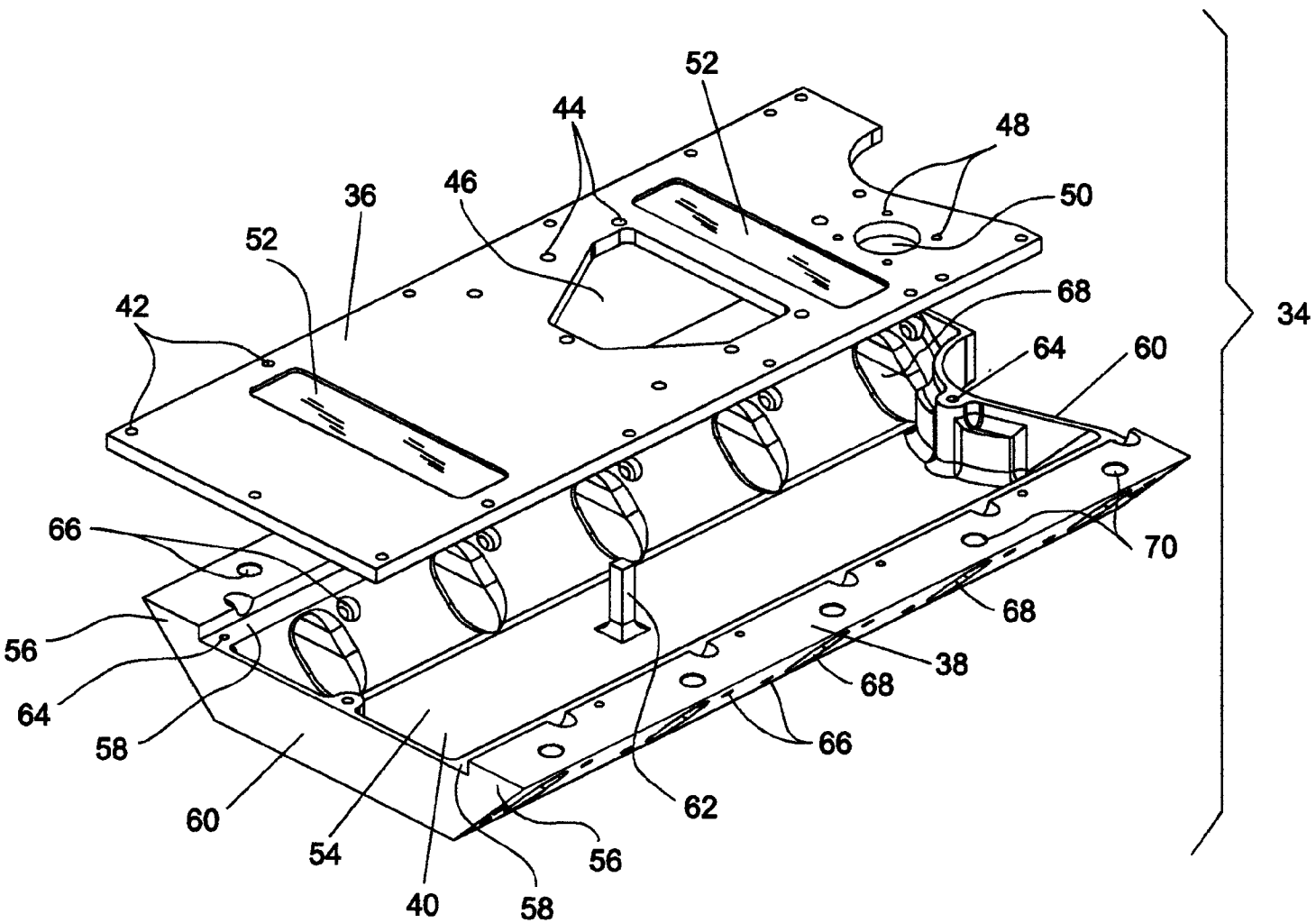
FIG. 2 is an exploded view of the intake manifold.

Referring now to FIG. 2, the intake manifold 34 includes a top plate 36, a base 38, and a plenum area 40. The intake manifold 34 according to the present invention may be made from solid aluminum rather than casting, which provides a less expensive manufacturing method for lower production runs due to economies of scale. The scope of the invention is not intended to be limited to the materials listed here, but may be carried out using any material which allows the construction and operation of the intake system 20 described herein. The intake manifold 34 shown in FIG. 2 is designed for use with a V-10 engine for the Dodge Viper. However, this is merely one embodiment of the present invention. It is understood that the intake manifold 34 shown in FIG. 2 may be modified for use with various engines of varying cylinder size without departing from the scope of the invention.

Figure 3:
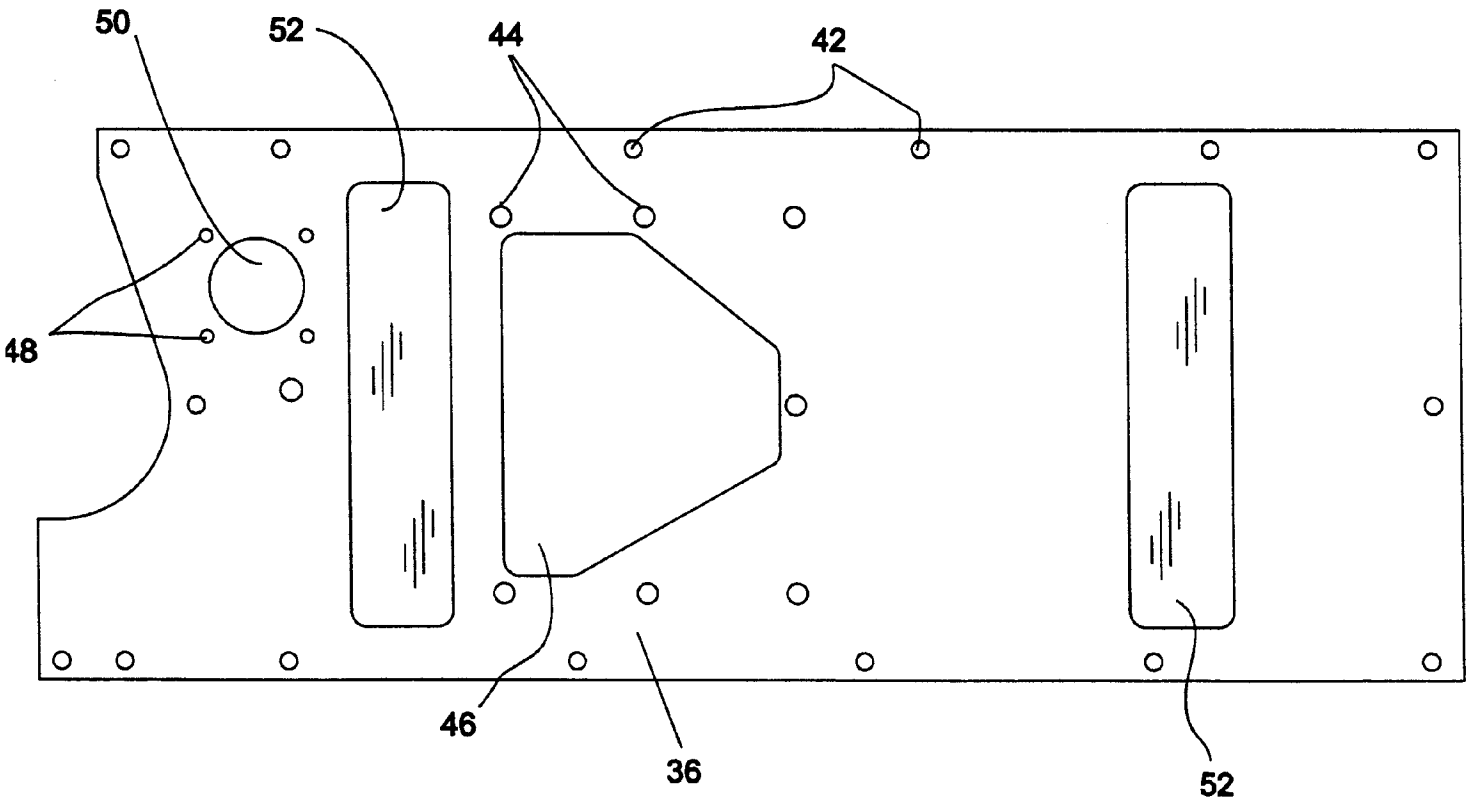
FIG. 3 is a top view of the top plate.
Figure 5:
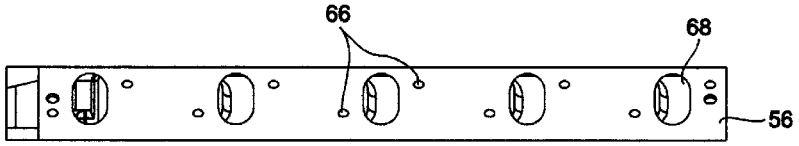
FIG. 5 is a right side view of the manifold base.

As seen in FIG. 3, the top plate 36 is shaped generally rectangular to correspond to the top of the manifold base 38, and whose shape is based on spatial needs for other components in the vehicles engine compartment. The top plate 36 is provided with top plate mounting holes 42 spaced along the perimeter of the top plate 36 and which receive fasteners (not shown), such as bolts, for mounting the top plate 36 to the manifold base 38. Air compressor mounting holes 44 are provided which receive fasteners (not shown), such as bolts, and enable the air compressor 24 to be mounted to the exterior of the top plate 36. An access port 46 enables air from an outlet of the air compressor 24 in fluid communication with the access port 46 to be supplied through the top plate 36 to the plenum area 40 of the intake manifold 34. Bypass valve mounting holes 48 are provided which receive fasteners (not shown), such as bolts, and enable the bypass valve 30 to be mounted to the exterior of the top plate 36. A bypass valve port 50 allows air to pass from the plenum area 40 through the top plate 36 to the bypass valve 30 and back into the intake tube 22 via the bypass valve connector 32 (FIG. 1). A bypass valve 30 suitable for use in an intake system 20 for a V-10 engine is an Eaton model bypass valve. As noted above, this is merely one embodiment of the present invention, and it is understood that the bypass valve 30 may be modified or various bypass valve models may be used without departing from the scope of the present invention.

An air compressor 24 suitable for use in an intake system 20 for a V-10 engine is an Opcon Autorotor MX424 twin screw positive displacement air compressor. As noted above, this is merely one embodiment of the present invention, and it is understood that the air compressor 24 may be modified or various air compressor models may be used without departing from the scope of the present invention. The air compressor 24 itself provides a means for forced induction of air into the engine, which is a known means of increasing power output of an engine. The air compressor 24 may be incorporated into the vehicle pulley system (not shown) to operate the air compressor 24. The top plate 36 may have air compressor end cap reliefs 52 which are depressions in the exterior surface of the top plate 36 to accommodate the particular structure of the Opcon Autorotor air compressor so as to enable an outlet of the air compressor 24 to be properly attached to the top plate 36 in order to ensure that virtually all of the air projected by the air compressor 24 will be projected through the access port 46.

The manifold base 38 is shown in FIGS. 4–9. The manifold base 38 includes a floor 54, side walls 56, rims 58 in the side walls 56, end walls 60, and a plenum support 62 extending upwardly from the floor 54.

The floor 54 of the manifold base 38 is substantially rectangular. The interior and exterior surface of the floor 54 are substantially planar and parallel to one another. The floor 54 is bounded on the longer sides by the side walls 56 of the manifold base 38 and on the shorter sides by the end walls 60. The side walls 56 extend angularly outwardly from the floor 54. The interior and exterior surfaces of the side walls 56 are substantially planar surfaces and parallel to one another. The end walls 60 extend vertically upwardly from the floor 54. The rims 58 are longitudinally formed in each of the side walls 56 adjacent to the top surfaces of the side walls 56 and at the same height as the tops of the end walls 60. The rims 58 provide substantially planar surfaces for receiving the top plate 36 and have a plurality of manifold base top plate mounting holes 64.

Figure 4:
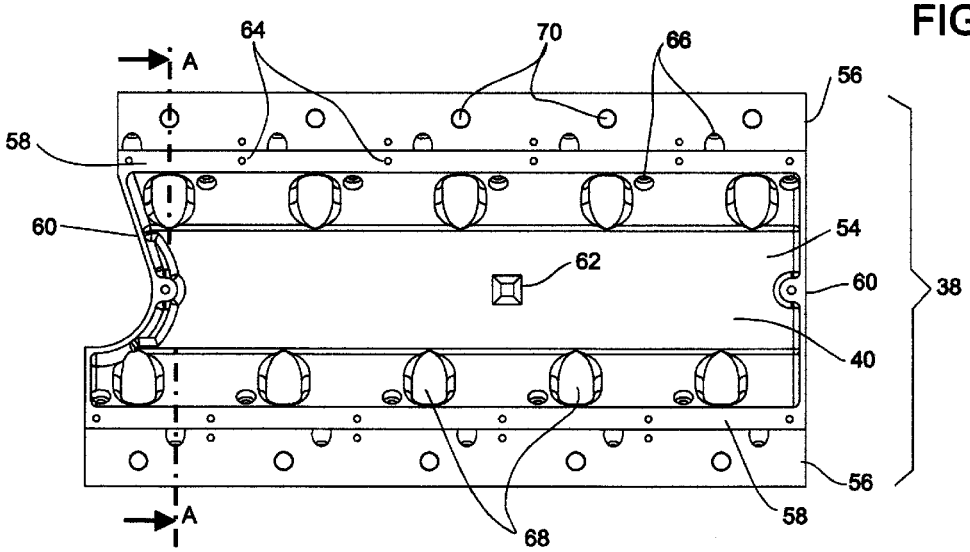
FIG. 4 is a top view of the manifold base.
Figures 6, 7, 8, 9:
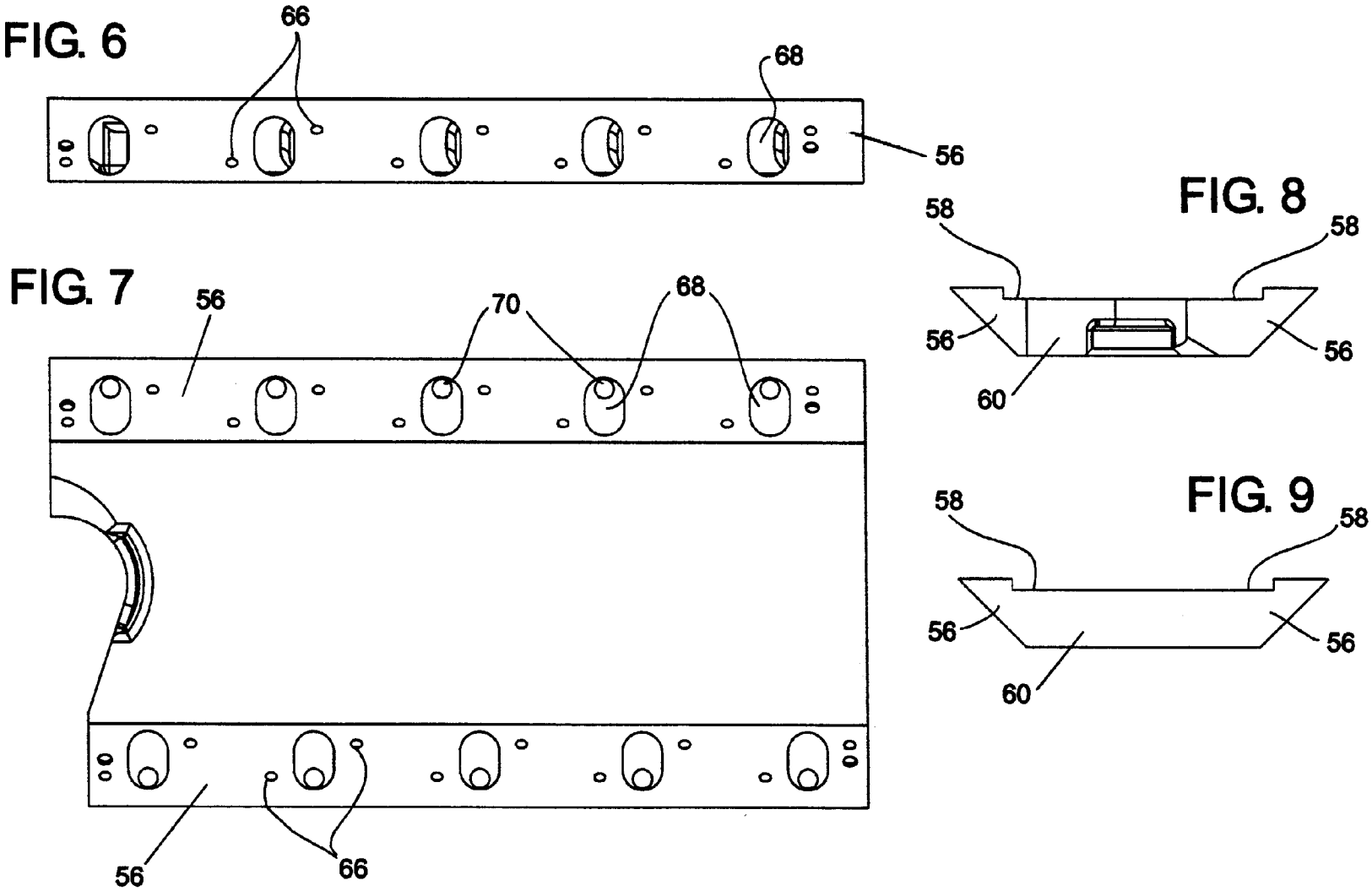
FIG. 6 is a left side view of the manifold base.
FIG. 7 is a bottom view of the manifold base.
FIG. 8 is a front view of the manifold base.
FIG. 9 is a rear view of the manifold base.
Figure 10:
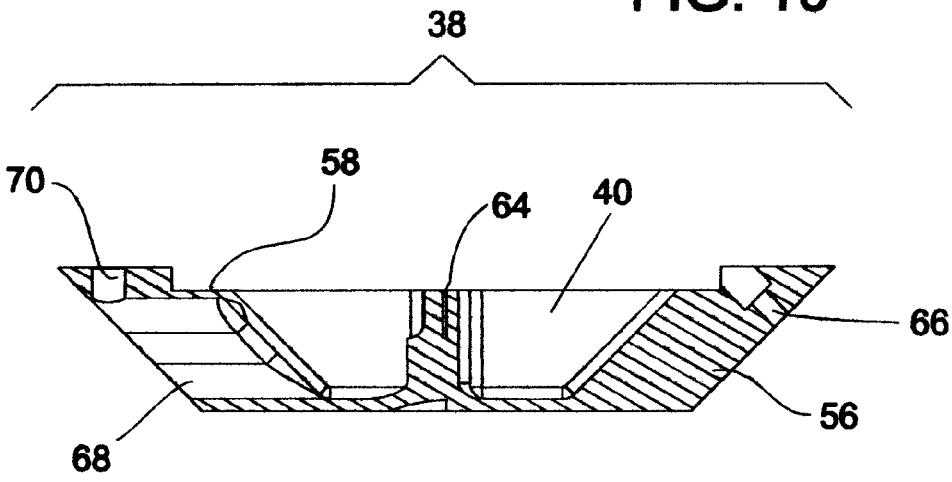
FIG. 10 is a cross-sectional view of the manifold base taken along the line A of FIG. 4.

As shown in FIG. 10, the side walls 56 define manifold base mounting holes 66, a plurality of runners 68, and fuel injection passages 70. The runners 68 extend through the side walls 56 and enable air from the plenum area 40 to be supplied to the engine cylinders (not shown). The length of the runners 68 is determined by the thickness of the side walls 56, which is preferably at least a minimum length necessary to provide sufficient fuel-flow velocity, allowing for a reduced profile for the intake system 20. In addition, the thickness of the side walls 56 provides sufficiently sound structure for the fuel injection passages 70 to be formed therein. As seen in FIGS. 4 and 10, the fuel injection passages 70 extend from the top surfaces of the side walls 56 on the exterior of the manifold base 38 through the side walls 56 and open into the runners 68 within the side walls 56. The fuel injection passages 70 enable fuel from the fuel injectors 26 to be supplied to the runners 68 for mixture with air, and the fuel-air mixture is supplied to the engine.

The side walls 56 of the manifold base 38 are provided with a plurality of mounting holes 66 that enable the manifold base 38 to be mounted to the engine (not shown) using mounting means, such as bolts. The manifold base 38 is mounted on the engine so that the runners 68 are aligned with the cylinder inlets of the engine to allow the fuel-air mixture to pass from the runners 68 to the cylinder inlets. The exterior surfaces of the side walls 56 are designed so that the manifold base 38 fits in the engine for which the manifold base 38 is made, in a manner to reduce the profile of the intake system 20 in combination with the engine. In the embodiment of the present invention show in FIGS. 4–9, the manifold base 38 fits onto the engine block of a V-10 engine such that the manifold base 38 mounts to the engine optimally in a retrofit or replacement application using the same mounting points on the engine as the original equipment manufacture intake manifold.

Figure 11:
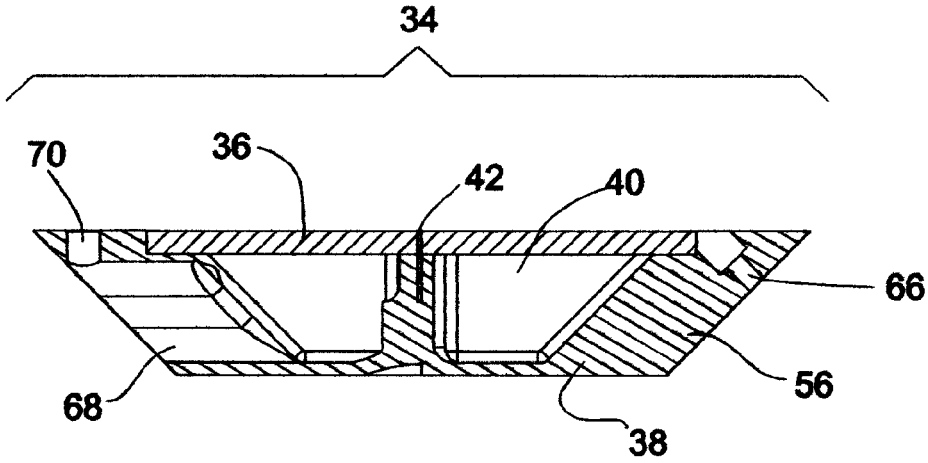
FIG. 11 is a cross-sectional view of the intake manifold based on FIG. 10 with the top plate in place.

The top plate 36 is attached to the manifold base 38 using bolts which pass through the top plate mounting holes 42 and into the manifold base top plate mounting holes 64 in the rims 58 formed in the side walls 56 of the manifold base 38. As seen in FIG. 11, when the top plate 36 is mounted to the manifold base 38, the top plate 36 and the interior surfaces of the floor 54, side walls 56, and end walls 60 define the plenum area 40 within the intake manifold 34. The top plate 36 mounts to the manifold base 38 so that several of the manifold base mounting holes 66 are covered or partially covered in order to prevent the associated manifold base mounting bolts from backing out, which could then enter and damage the engine. The plenum support 62 extends upwardly from the floor 54 into the plenum area 40 to approximately the same height as the rims 58 to provide structural support to the top plate 36 which, as described above, supports the top-mounted air compressor 24.

The two-piece design of the intake manifold 34 facilitates installation of the air compressor 24 to the exterior of the top plate 36 by providing access to the interior of the top plate 36 to enable mounting means, typically bolts, for the air compressor 24 to secure the air compressor 24 to the top plate 36 via the air compressor mounting holes 44. The top plate 36 with the mounted air compressor 24 can then be mounted on the manifold base 38 which is already mounted on the engine. The air compressor 24 is optional for the intake system 20, and if not present, the intake tubes 22 may alternatively be attached to the access port 46 of the intake manifold 34 to supply air to the intake manifold 34.

In use, with the intake system 20 of the present invention mounted on the engine and when the engine is running, the inlet end of each intake tube 22 receives air from the environment. The air compressor 24 receives air from the intake tubes 22 and compresses the received air. The air compressor 24 projects the compressed air through the access port 46 in the top plate 36 and into the plenum area 40 of the intake manifold 34. The air in the plenum area 40 disperses into the runners 68.

Fuel is supplied by the fuel system (not shown) into the fuel injector rails 45, which in turn supply the fuel to the fuel injectors 26. The fuel injectors 26 supply fuel through the fuel injection passages 70 and into the runners 68. In the runners 68, the fuel supplied from the fuel injection passages 70 mixes with the air supplied from the plenum area 40. The fuel-air mixture is then delivered into each cylinder of the engine via a cylinder inlet in the engine block.

The bypass valve 30 is actuated by a vacuum diaphragm/actuator, which receives a vacuum signal from the plenum area 40. When under engine vacuum, during low engine loads, the bypass valve 30 opens allowing air in the plenum area 40 of the intake manifold 34 to circulate through the bypass valve port 50, the bypass valve 30, the bypass valve connector 32, the intake tube 22, and back into the air compressor 24, cooling the air compressor 24 and the air charge produced by the air compressor 24. During heavy acceleration/loads, when power demand is high and vacuum is low, the bypass valve 30 closes. The bypass valve 30 is optional for the intake system 20 of the present invention. If the bypass valve 30 is not used, the bypass valve connector 32 would not be used as well, and the top plate 36 would not have the bypass valve mounting holes 48 and bypass valve port 50. The bypass valve 30 typically would not be used if the air compressor 24 is not used, as the bypass valve 30 operates to reduce drag that can be created by positive displacement from an air compressor 24 that is not present in a normally aspirated engine.

The low profile design of the intake manifold 34 according to the present invention allows the intake system 20 with a top-mounted air compressor 24 to be able to fit within the engine compartment under the original equipment manufacturer hood in a closed position. This low profile design offers an improved, easy to install intake system 20 which saves time, and saves money by enabling installation of the intake system 20 without having to purchase an aftermarket hood or the expense of modifying the present hood.

Although the present invention has been shown and described in considerable detail with respect to only a particular exemplary embodiment thereof, it should be understood by those skilled in the art that there is no intent to limit the invention to the embodiment since various modifications, omissions, and additions may be made to the disclosed embodiment without materially departing from the novel teachings and advantages of the invention, particularly in light of the foregoing teachings. For example, while the intake manifold 34 shown in FIG. 2 is designed for use with a V-10 engine for the Dodge Viper, this is merely one embodiment of the present invention. It is understood that the intake manifold 34 shown in FIG. 2 may be modified for use with various engines of varying cylinder size without departing from the scope of the invention. Accordingly, the intent is to cover all such modifications, omissions, additions, and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may both be structural equivalents in that a nail employs a cylindrical surface to secure wooden parts together, whereas a screw employs a helical surface, in the environment of fastening wooden parts, a nail and screw may be equivalent structures.

The invention claimed is:

1. An intake manifold for an engine, including an engine block with at least one cylinder inlet which is supplied with an air-fuel mixture from the intake manifold, the intake manifold comprising:

a housing defining an interior cavity and having an exterior surface, the housing having at least one air in-flow passage from the exterior surface of the housing to the interior cavity, and the housing including at least one side wall, the side wall having a substantially planar side wall interior cavity surface and a side wall exterior surface, the side wall defining at least one air-fuel out-flow passage from the interior cavity to the side wall exterior surface, the housing having at least one fuel in-flow passage which extends from the exterior surface of the housing directly to the air-fuel out-flow passage at a location between the interior cavity and the exterior surface of the housing, wherein the intake manifold is mounted to engage the engine block so that the air-fuel out-flow passage and the engine cylinder inlet are aligned to allow the air-fuel mixture to pass from the air-fuel out-flow passage to the engine cylinder inlet.

2. An intake manifold for an engine, including an engine block with at least one cylinder inlet, the intake manifold comprising:

a housing having an exterior surface and defining an interior cavity, the housing having at least one air in-flow passage from the exterior surface of the housing to the interior cavity, the housing having at least one side wall, the side wall defining at least one air-fuel out-flow passage from the interior cavity to the side wall exterior surface, and the housing defining at least one fuel in-flow passage from the exterior surface of the housing and opens directly into the air-fuel out-flow passage which extends at a location between the interior cavity and the exterior surface of the housing.

* * * * *